US009512370B2

(12) United States Patent
Soliman

(10) Patent No.: US 9,512,370 B2
(45) Date of Patent: Dec. 6, 2016

(54) DEVELOPMENT OF CONTINUOUS ONLINE SALT-IN-CRUDE ANALYZER

(71) Applicant: Saudi Arabian Oil Company, Dhahran (SA)

(72) Inventor: Mohamed Ahmed A. Soliman, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 371 days.

(21) Appl. No.: 14/077,389

(22) Filed: Nov. 12, 2013

(65) Prior Publication Data

US 2014/0131254 A1 May 15, 2014

Related U.S. Application Data

(60) Provisional application No. 61/725,145, filed on Nov. 12, 2012.

(51) Int. Cl.

| | |
|---|---|
| ***C10G 33/08*** | (2006.01) |
| ***C10G 31/08*** | (2006.01) |
| ***C10G 33/04*** | (2006.01) |

(52) U.S. Cl.

CPC ..... *C10G 33/08* (2013.01); *C10G 31/08* (2013.01); *C10G 33/04* (2013.01)

(58) Field of Classification Search

CPC ..... C10G 33/04; C10G 33/08; C10G 31/08
See application file for complete search history.

(56) References Cited

U.S. PATENT DOCUMENTS

| | | | | |
|---|---|---|---|---|
| 4,209,695 | A | 6/1980 | Arnold et al. | |
| 4,352,288 | A | 10/1982 | Paap et al. | |
| 4,581,134 | A | 4/1986 | Richter et al. | |
| 2008/0149486 | A1 | 6/2008 | Greaney et al. | |
| 2011/0100877 | A1* | 5/2011 | Snawerdt ..... | C10G 17/02 208/178 |

OTHER PUBLICATIONS

Manning et al., Oilfield Processing of Petroleum: Crude oil, Chapter 8 Desalting of Crude Oil, 1995, pp. 145-155.*

PCT International Search Report and the Written Opinion of the International Searching Authority dated Feb. 10, 2014; International Application No. PCT/US2012/069526; International File Date: Nov. 12, 2013.

* cited by examiner

*Primary Examiner* — Prem C Singh
*Assistant Examiner* — Brandi M Doyle
(74) *Attorney, Agent, or Firm* — Bracewell LLP; Constance Gall Rhebergen

(57) ABSTRACT

The present invention relates to online analysis of crude oil from desalting processes. Online analysis of the crude oil that has been desalted will allow for real time adjustments to process operating parameters such that the salt concentration of the crude oil is maintained within acceptable parameters. This online analysis can yield a more efficient process, reduce energy consumption of the desalting process, and maintain corrosion rates within acceptable limits.

16 Claims, 3 Drawing Sheets

DEVELOPMENT OF CONTINUOUS ONLINE SALT-IN-CRUDE ANALYZER

This application claims priority to U.S. Provisional Application Ser. No. 61/725,145 filed on Nov. 12, 2012, which is incorporated by reference in its entirety.

FIELD OF INVENTION

This invention generally relates to the field of analyzers for salt in crude. More specifically, it relates to the online analysis of crude oil from desalting processes.

BACKGROUND

Currently, salt content measurement in the crude oil production and refining industry follows either the standard reference method ASTM D3230 or ASTM D6470, both of which are incorporated herein by reference. ASTM D6470 is not practical for online measurement as it requires extraction steps. ASTM D3230 requires the utilization of a combination of three chemicals: methanol, butanol, and xylene, to reduce the crude oil resistivity to a measurable range for traditional sensors and common instrumentation. However, these solvents are extremely toxic, volatile, and flammable, which makes them particularly difficult to handle in facilities located in hot environments.

The principle of the method outlined in ASTM D3230 is to dilute a crude oil sample in an alcoholic mixture in order to allow for conductivity readings and to compare the readings to reference values. This method can be applied either off-line on a collected sample or online. Off-line measurements are susceptible to errors due to unequal gas desorption, which can be attributed to time lag between sampling and measurement and/or variations of the external temperature and/or the crude oil temperature, improper mix of chemicals, measurement errors, and data reporting. Online measurements avoid manual sampling and prevent some potential errors. However, in high temperature environments, the use of volatile solvents is inadvisable because it can lead to fires, explosions, or intoxication. Another disadvantage of ASTM D3230 is the limitation in solvent quantity stored on site due to flammability concerns and risks of explosion.

Furthermore, xylene, methanol, and butanol must be added in precise proportions, as any minimum alteration in their volumetric ratio, which is even more likely to occur at high temperatures due to their volatile nature, disturbs the homogeneity and causes erroneous measurement readings. This leads to a complicated measurement procedure, thereby introducing potential errors. Moreover, these issues also require bulky equipment with frequent and careful maintenance.

Currently, there are no effective, efficient, and easy to use online analyzers for monitoring salt content in treated crude. The available online salt-in-crude analyzers are generally expensive and require high maintenance, as well as the use of solvents, as required by the ASTM standards. The frequent replacements of chemicals and the presence of moving parts in the analyzer make the analyzer labor-intensive and requires constant maintenance. Currently available online nuclear and radioactive-based salt-in-crude analyzers also require high maintenance and provide unreliable measurement. Additionally, off-line monitoring requires laboratory sampling to monitor the PTB. However, it is very easy to miss the product specification based on the timing of sampling collections and using an off-line monitoring system.

Therefore, it would be beneficial to provide a method and apparatus that is capable of measuring the salt concentration online and also modifying operating conditions such that salt concentration is maintained.

SUMMARY

The present invention relates to online analysis of crude oil from desalting processes. Online analysis of the crude oil that has been desalted will allow for real time adjustments to process operating parameters such that the salt concentration of the crude oil is maintained within acceptable parameters. This online analysis can yield a more efficient process, reduce energy consumption of the desalting process, and maintain corrosion rates within acceptable limits.

In some embodiments, the present invention provides a process for monitoring salinity of a dry crude stream. The process includes the steps of feeding a recycled water stream using at least one recycled water pump having a predetermined range of operating conditions and at least one emulsion breaking chemical using an emulsion breaking chemical injection system having a predetermined range of operating conditions, to a wet crude stream to produce an enhanced wet crude stream with water and emulsion breaking chemicals. The wet crude stream with water and emulsion breaking chemicals is then fed to a first mixing apparatus having a predetermined range of operating conditions to produce a mixed wet crude stream. The mixed wet crude stream is then id to a dehydrator vessel having a predetermined range of operating conditions to produce a reduced water content crude stream and a waste water stream. The waste water stream is then fed to a waste water facility using at least one waste water stream pump having a predetermined range of operating conditions. A wash water stream is then fed using at least one wash water pump having a predetermined range of operating conditions to the reduced water content crude stream to produce a hydrated crude stream. The hydrated crude stream is then fed to a second mixing apparatus having a predetermined range of operating conditions to produce a mixed hydrated crude stream. The mixed hydrated crude stream is then fed to a desalter vessel having a predetermined range of operating conditions to produce a dry crude stream and the recycled water stream. The dry crude stream is fed to an analyzing unit for determining the basic sediment and water (BSW) of the dry crude stream. The recycled water stream is fed to an analyzing unit for determining total dissolved solids (TDS) of the recycled water stream from a desalting unit. A salt concentration in the dry crude stream is determined based on a predetermined correlation of BSW and TDS. A multivariable controller is used to assess the operating parameters within the predetermined range of operating conditions of any of the wet crude stream pump, recycled water pump, emulsion breaking chemical injection system, first mixing apparatus, dehydrator vessel, waste water stream pump, wash water pump, second mixing apparatus, and desalter vessel. The multivariable controller then adjusts one or more of operating parameters within the predetermined range of operating conditions to maintain the salt concentration in the dry crude stream within a predetermined range such that power usage of the process is minimized.

In other embodiments, the present invention provides an apparatus for controlling content of impurity in a crude oil stream. The apparatus includes at least one mixing apparatus for receiving a water stream and a wet crude stream and for mixing the water and wet crude stream to provide a wet crude stream with water. The apparatus also includes at least one emulsion breaking chemical injection system for injecting an emulsion breaking chemical into the wet crude stream with water. The apparatus also includes at least one dehydrator vessel for receiving the wet crude stream with water for removing an amount of water to provide a reduced water content crude stream and a waste water stream. The apparatus also includes at least one water pump for pumping the water stream. The apparatus further includes at least one desalter vessel for removing salt from the reduced water content crude stream to produce a dry crude stream and a second waste water stream. The apparatus also includes a first impurity analyzer for measuring BSW of the dry crude stream and operable to provide a measurement of a BSW value to a controller. The apparatus further includes a second impurity analyzer for measuring TDS of the water stream and is operable to provide a measurement of a TDS value to the controller. The apparatus also includes a multivariable controller operable to perform an assessment of the BSW value and the TDS value using a predefined correlation. The controller is further operable to adjust at least one operating parameter of at least one of the mixing apparatus, the emulsion breaking chemical injection system, water pump, desalter vessel, first impurity analyzer, and second impurity analyzer, such that the power consumption of the apparatus for controlling content of impurity in a crude oil stream is optimized.

The features and advantages of the present invention will be readily apparent to those skilled in the art upon a reading of the description of the preferred embodiments that follow.

BRIEF DESCRIPTION OF THE DRAWINGS

So that the manner in which the features and advantages of the invention, as well as others, which will become apparent, may be understood in more detail, a more particular description of the invention briefly summarized above may be had by reference to the embodiments thereof, which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Although the following detailed description contains many specific details for purposes of illustration, it is understood that one of ordinary skill in the relevant art will appreciate that many examples, variations, and alterations to the following details are within the scope and spirit of the invention. Accordingly, the exemplary embodiments of the invention described herein are set forth without any loss of generality, and without imposing limitations, relating to the claimed invention.

Figure 1:
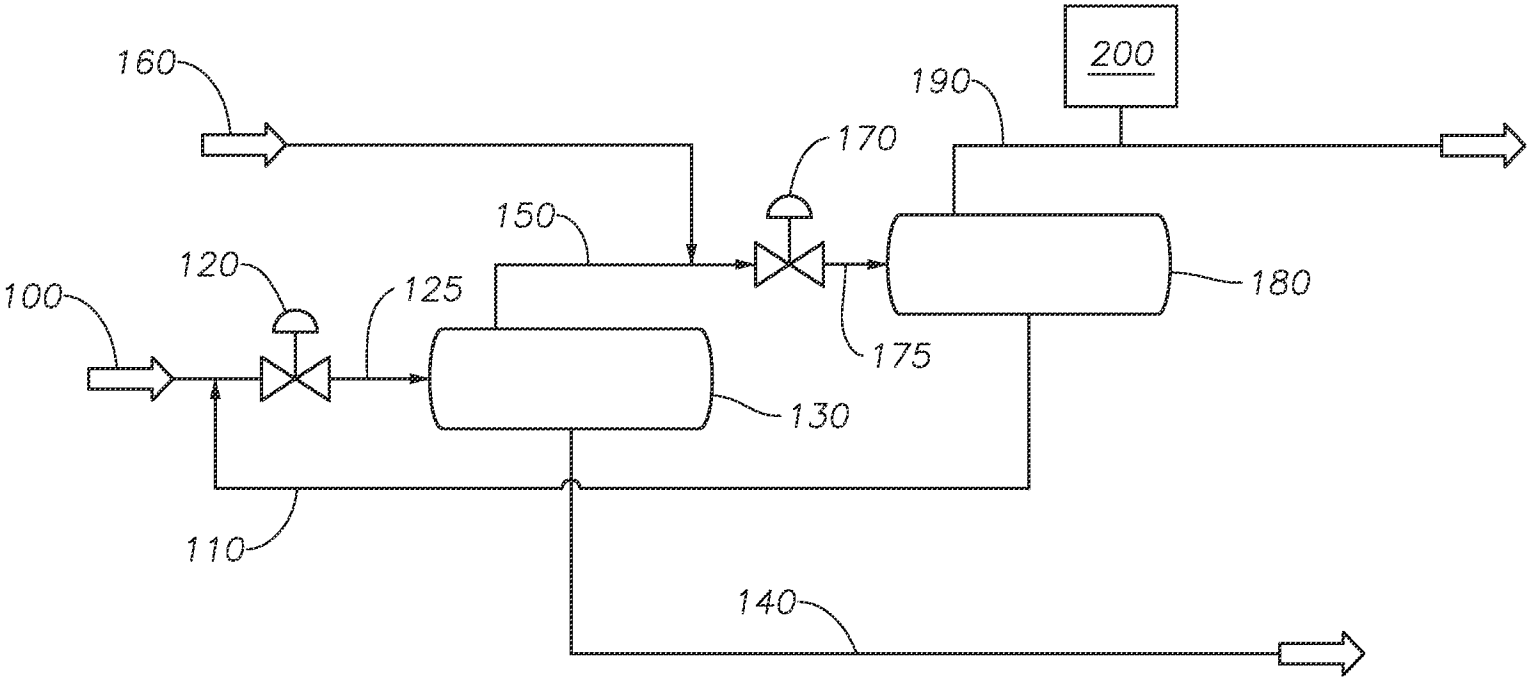
FIG. 1 shows a conventional salt in crude analyzer.

In desalting processes known in the art, analysis of samples of the dry crude stream is usually done offline, such as in laboratories. As shown in FIG. 1, which is one version of known desalting processes, wet crude stream 100 and water stream 110 are fed, along with emulsion breaking chemicals, to first mixing apparatus 120 to produce mixed wet crude stream 125, which is then fed to dehydrating vessel 130. The dehydrating vessel then separates waste water stream 140 from reduced water content crude stream 150. Reduced water content crude stream 150 is then combined with wash water stream 160 using second mixing apparatus 170 to create mixed hydrated crude stream 175, which is fed to desalter vessel 180. From the desalter vessel, water stream 110 is produced which can be recycled to be fed to wet crude stream 100. Dry crude stream 190 is also produced from desalter vessel 180. In the various configurations of the desalting processes known in the prior art, samples 200 are taken from dry crude stream 190. These samples usually monitor the BSW of the dry crude stream of line in a laboratory setting. From the BSW, the concentration of salt in the dry crude stream is determined. This process does not allow for online monitoring of the salt content of the dry crude stream. Additionally, the known processes do not allow for continuous monitoring and real time adjustments of various operating parameters to adjust the salt concentration of the dry crude stream to required levels.

The online analysis provided by the impurity analyzers of embodiments of the present invention will allow for automation of the operations of a desalter operation such that the energy consumption of the desalter operation is minimized, water use is minimized, and the use of emulsion breaking chemicals is minimized, such that costs associated with producing desalted crude to set specifications will be reduced. This is accomplished by use of a multivariable controller, which is operable to adjust operating parameters in response to information provided by the online impurity analyzers which determine the BSW of the dry crude stream and the total dissolved solids TDS of the recycled water stream from a desalting unit. A salt concentration in the dry crude stream is determined based on a predetermined correlation of BSW and TDS. The invention can be used for continuous monitoring and control of the salt concentration of the crude stream.

In some embodiments, the present invention provides a process for monitoring salinity of a dry crude stream. The process includes the steps of feeding a recycled water stream using at least one recycled water pump having a predetermined range of operating conditions and at least one emulsion breaking chemical using an emulsion breaking chemical injection system having a predetermined range of operating conditions, to a wet crude stream to produce an enhanced wet crude stream with water and emulsion breaking chemicals. The wet crude stream with water and emulsion breaking chemicals is then fed to a first mixing apparatus having a predetermined range of operating conditions to produce a mixed wet crude stream. The mixed wet crude stream is then fed to a dehydrator vessel having a predetermined range of operating conditions to produce a reduced water content crude stream and a waste water stream. The waste water stream is then fed to a waste water facility using at least one waste water stream pump having a predetermined range of operating conditions. A wash water stream is then fed using at least one wash water pump having a predetermined range of operating conditions to the reduced water content crude stream to produce a hydrated crude stream. The hydrated crude stream is then fed to a second mixing apparatus having a predetermined range of operating conditions to produce a mixed hydrated crude stream. The mixed hydrated crude stream is then fed to a desalter vessel having a predetermined range of operating conditions to produce a dry crude stream and the recycled water stream. The dry crude stream is fed to an analyzing unit for determining the BSW of the dry crude stream. The recycled water stream is fed to an analyzing unit for determining TDS of the recycled water stream from a desalting unit. A salt concentration in the dry crude stream is determined based on a predetermined correlation of BSW and TDS. A multivariable controller is used to assess the operating parameters within the predetermined range of operating conditions of any of the wet crude stream pump, recycled water pump, emulsion breaking chemical injection system, first mixing apparatus, dehydrator vessel, waste water stream pump, wash water pump, second mixing apparatus, and desalter vessel. The multivariable controller then adjusts one or more of operating parameters within the predetermined range of operating conditions to maintain the salt concentration in the dry crude stream within a predetermined range such that power usage of the process is minimized.

Figure 2:
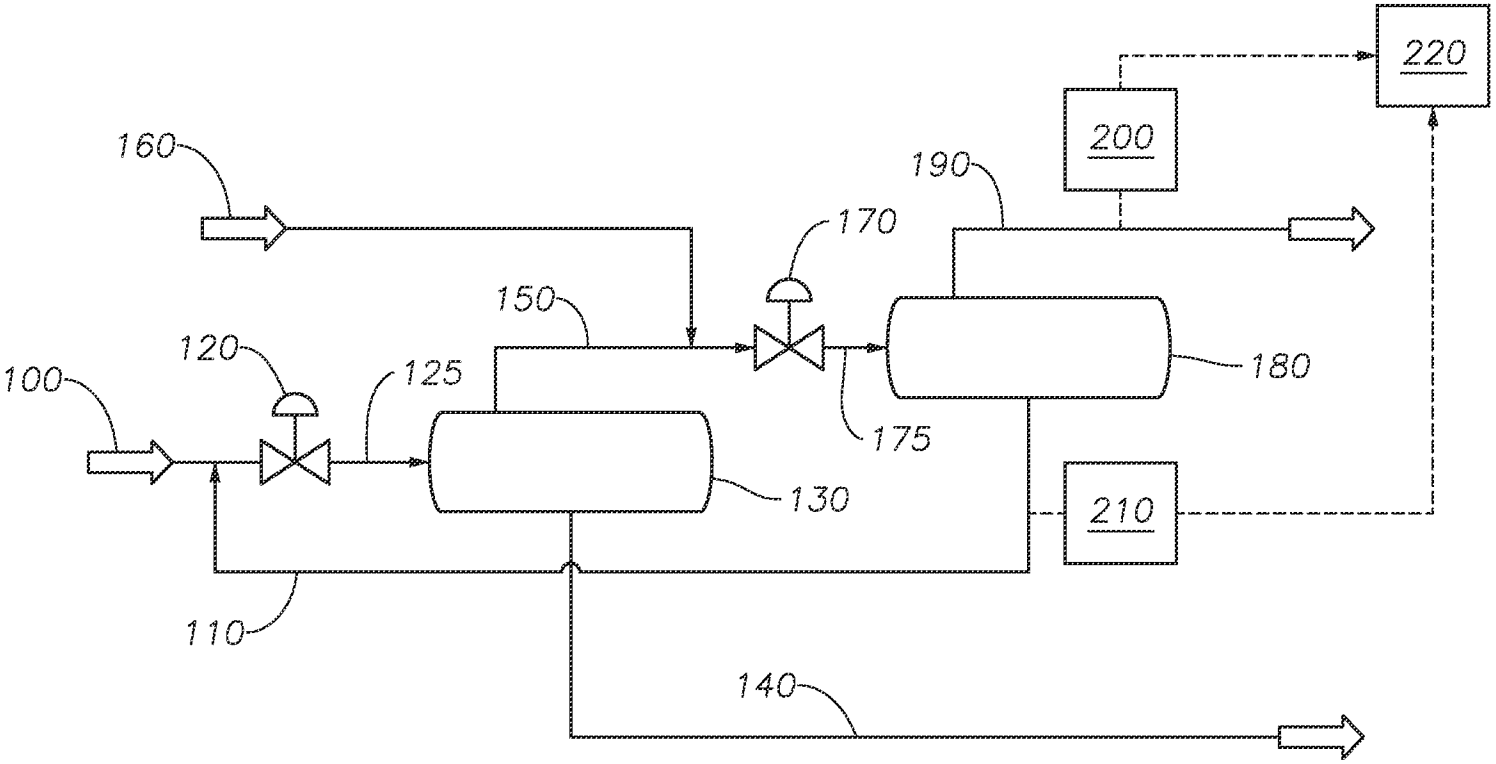
FIG. 2 shows an apparatus for measuring crude salinity in accordance with an embodiment of the invention.

As shown in FIG. 2, one embodiment of the invention is a desalting process which feeds wet crude 100 and recycled water stream 110 along with emulsion breaking chemicals to first mixing apparatus 120 to produce mixed wet crude stream 125 which is fed to dehydrator vessel 130. The dehydrator vessel then separates waste water stream 140 from reduced water content crude stream 150. Reduced water content crude stream 150 is then combined with wash water stream 160 using second mixing apparatus 170 to create mixed hydrated crude stream 175 which is fed to desalter vessel 180. From desalter vessel 180, water stream 110 is produced which can be recycled and fed to wet crude stream 100. Dry crude stream 190 is also produced from desalter vessel 180. In the embodiment shown in FIG. 2, the TDS of recycled water stream 110 is analyzed using impurity analyzer 210. The BSW of the dry crude stream 190 is also assessed using impurity analyzer 200. The salt concentration in the dry crude stream is then assessed by an online analyzer 220 using a predetermined correlation of TDS and BSW.

Figure 3:
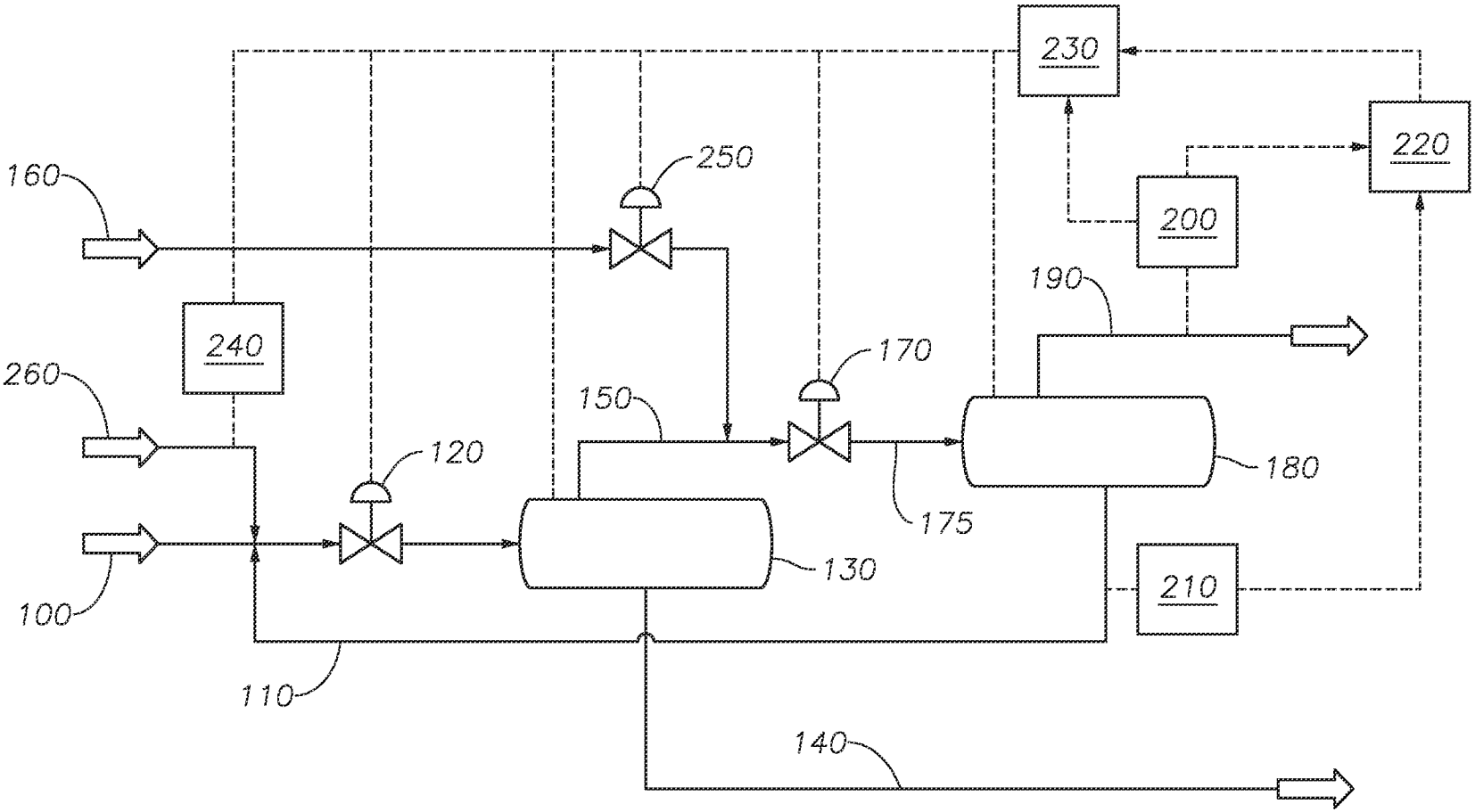
FIG. 3 shows an apparatus for measuring crude salinity in accordance with an embodiment of the invention.

As shown further in FIG. 3, online analyzer 220 can communicate with multi variable controller 230. In some embodiments, online analyzer 220 and multivariable controller 230 can be a single unit. Emulsion breaking chemicals 260 can be added to wet crude stream 100 at the same time as the recycled water stream 110, as shown in FIG. 3. The multivariable controller 230 is operable to assess operating parameters of first mixing apparatus 120, second mixing apparatus 170, dehydrator vessel 130, desalter vessel 180, and emulsion breaking chemical injection systems 240 and 250 and to adjust operating parameters of one or more of first mixing apparatus 120, second mixing apparatus 170, dehydrator vessel 130, desalter vessel 180, and emulsion breaking chemical injection systems 240 and 250 in order to adjust the salt concentration in the dry crude and to reduce overall chemical, wash water, and power consumption of the process. Additionally, a person of skill in the art will understand that the wash water stream and recycled water streams will be pumped using a wash water pump and a recycled water pump, respectively. The multivariable controller can also be operable to assess operating parameters of the wash water pump and the recycled water pump and adjust the operating parameters in order to adjust the salt concentration in the dry crude and to reduce overall power consumption of the process.

In some embodiments, the predetermined range of the salt concentration in the dry crude stream is less than 10 lb/1000 barrels. In another embodiment, the predetermined range of the salt concentration in the dry crude stream is less than 5 lb/1000 barrels.

The at least one emulsion breaking chemical fed to the wet crude stream can be a single chemical or a mixture of several emulsion breaking chemicals. Emulsion breaking chemicals for use in the process are well-known in the art.

In further embodiments, the at least one emulsion breaking chemical is injected using the emulsion breaking chemical injection system at a lowest injection rate required to maintain the salt concentration in the dry crude stream at less than 10 lb/1000 barrels. In further embodiments, the at least one emulsion breaking chemical is injected using the emulsion breaking chemical injection system at a lowest injection rate required to maintain the salt concentration in the dry crude stream at less than 5 lb/1000 barrels.

In yet a further embodiment, the injection rate of the emulsion breaking chemical injection system is such that it results in a concentration of emulsion breaking chemical of 3-10 ppm of the mixed wet crude.

In other embodiments, additional emulsion breaking chemicals can be fed to the wash water stream using a second emulsion breaking chemical injection system. The emulsion breaking chemicals fed to the wash water stream can be the same as or different than the emulsion breaking chemicals fed to a wet crude stream. The emulsion breaking chemicals fed to the wash water stream can be a single chemical or a mixture of several emulsion breaking chemicals.

In further embodiments, the additional emulsion breaking chemicals are injected using the second emulsion breaking chemical injection system at a lowest injection rate required to maintain the salt concentration in the dry crude stream at less than 10 lb/1000 barrels. In further embodiments, the additional emulsion breaking chemicals are injected using the second emulsion breaking chemical injection system at a lowest injection rate required to maintain the salt concentration in the dry crude stream at less than 5 lb/1000 barrels.

In some embodiments, the at least one wash water pump is operated within predetermined range of operating conditions at a lowest level of flow required to maintain the salt concentration in the dry crude stream at less than 110 lb/1000 barrels. In other embodiments, the at least one wash water pump is operated within a predetermined range of operating conditions at a lowest level of flow required to maintain the salt concentration in the dry crude stream at less than 5 lb/1000 barrels.

In some embodiments, the first mixing apparatus is operated within a predetermined range of operating conditions at a lowest mixing efficiency and for the least amount of time required to maintain the salt concentration in the dry crude stream at less than 10 lb/1000 barrels. In other embodiments, the first mixing apparatus is operated within a predetermined range of operating conditions at a lowest mixing efficiency and for the least amount of time required to maintain the salt concentration in the dry crude stream at less than 5 lb/1000 barrels.

In other embodiments, the dehydrator vessel is operated within a predetermined range of operating conditions at a lowest level of energy consumption required to main the salt concentration in the dry crude stream at less than 10 lb/1000 barrels. In further embodiments, the dehydrator vessel is operated within a predetermined range of operating conditions at a lowest level of energy consumption required to maintain the salt concentration in the dry crude stream at less than 5 lb/1000 barrels.

In other embodiments, the at least one waste water stream pump is operated within the predetermined range of operating conditions at a lowest level of flow required to maintain the salt concentration in the dry crude stream at less than 10 lb/1000 barrels. In further embodiments, the at least one waste water stream pump is operated within the predetermined range of operating conditions at a lowest level of flow required to maintain the salt concentration in the dry crude stream at less than 5 lb/1000 barrels.

In other embodiments, the at least one recycled water pump is operated within the predetermined range of operating conditions at a lowest level of flow required to maintain the salt concentration in the dry crude stream at less than 10 lb/1000 barrels. In further embodiments, the at least one recycled water pump is operated within the predetermined range of operating conditions at a lowest level of flow required to maintain the salt concentration in the dry crude stream at less than 5 lb/1000 barrels.

In another embodiment, the wet crude stream pump is operated within a predetermined range of operating conditions at a lowest level of flow required to maintain the salt concentration in the dry crude stream at less than 10 lb/1000 barrels. In further embodiments, the wet crude stream pump is operated within a predetermined range of operating conditions at a lowest level of flow required to maintain the salt concentration in the dry crude stream at less than 5 lb/1000 barrels.

In another embodiment, the second mixing apparatus is operated within a predetermined range of operating conditions at a lowest mixing efficiency and for the least amount of time required to maintain the salt concentration in the dry crude stream at less than 10 lb/1000 barrels. In further embodiments, the second mixing apparatus is operated within a predetermined range of operating conditions at a lowest mixing efficiency and for the least amount of time required to maintain the salt concentration in the dry crude stream at less than 5 lb/1000 barrels.

In another embodiment, the desalter vessel is operated within a predetermined range of operating conditions at a lowest level of energy consumption required to maintain the salt concentration in the dry crude stream at less than 10 lb/1000 barrels. In further embodiments, the desalter vessel is operated within a predetermined range of operating conditions at a lowest level of energy consumption required to maintain the salt concentration in the dry crude stream at less than 5 lb/1000 barrels.

In another embodiment, the desalter vessel is operated within a predetermined range of operating conditions at a temperature of between about 50-150° C.

In a further embodiment, the multivariable controller adjusts one or more of the operating parameters within the predetermined range of operating conditions of the wet crude stream pump, recycled water pump, emulsion breaking chemical injection system, first mixing apparatus, dehydrator vessel, waste water stream pump, wash water pump, second mixing apparatus, and desalter vessel such that the energy consumption of the process is at a minimum level required to maintain a salt concentration in the dry crude stream of less than 10 lb/1000 barrels.

In a further embodiment, the multivariable controller adjusts the operating parameters within the predetermined range of operating conditions of the wet crude stream pump, recycled water pump, emulsion breaking chemical injection system, first mixing apparatus, dehydrator vessel, waste water stream pump, wash water pump, second mixing apparatus, and desalter vessel such that the energy consumption of the process is at a minimum level required to maintain a salt concentration in the dry crude stream of less than 5 lb/1000 barrels.

In other embodiments, the present invention provides an apparatus for controlling content of an impurity in a crude oil stream. The apparatus includes at least one mixing apparatus for receiving a water stream and a wet crude stream for mixing water and wet crude stream to provide a wet crude stream with water. The apparatus also includes at least one emulsion breaking chemical injection system for injecting an emulsion breaking chemical into the wet crude stream with water. The apparatus also includes at least one dehydrator vessel for receiving the wet crude stream with water for removing an amount of water to provide a reduced water content crude stream and a waste water stream. The apparatus also includes at least one water pump for pumping the water stream. The apparatus further includes at least one desalter vessel for removing salt from the reduced water content crude stream to produce a dry crude stream and a second waste water stream. The apparatus also includes a first impurity analyzer for measuring BSW of the dry crude stream and operable to provide a measurement of a BSW value to a controller. The apparatus further includes a second impurity analyzer for measuring TDS of the water stream and operable to provide a measurement of a TDS value to the controller. The apparatus also includes a multivariable controller operable to perform an assessment of the BSW value and the IDS value using a predefined correlation. The controller is further operable to adjust at least one operating parameter of at least one of the mixing apparatus, the emulsion breaking chemical injection system, water pump, desalter vessel, first impurity analyzer, and second impurity analyzer, such that the power consumption of the apparatus for controlling content of impurity in a crude oil stream is optimized.

In some embodiments, the impurity in the crude oil stream that is controlled is salt.

In a further embodiment, the BSW in the dry crude stream is less than about 0.2% by volume of the dry crude stream, or less than about 0.1% by volume of the dry crude stream.

In some embodiments of the apparatus, the multivariable controller is operable to control one or more operating parameters of the mixing apparatus, the emulsion breaking chemical injection system, water pump, desalter vessel, first impurity analyzer, and second impurity analyzer so as to maintain the BSW value of the dry crude stream at a maximum of about 0.2% volume of the dry crude stream.

In some embodiments of the apparatus, the multi-variable controller is operable to control one or more operating parameters of the mixing apparatus, the emulsion breaking chemical injection system, water pump, desalter vessel, first impurity analyzer, and second impurity analyzer so as to maintain the BSW value of the dry crude stream at a maximum of about 0.1% volume of the dry crude stream.

In further embodiments of the apparatus, the multivariable controller is operable to control one or more operating parameters of the mixing apparatus, the emulsion breaking chemical injection system, water pump, desalter vessel, first impurity analyzer, and second impurity analyzer to maintain a salt concentration in the dry crude stream of less than 10 lb/1000 barrels.

In further embodiments of the apparatus, the multivariable controller is operable to control one or more operating parameters of the mixing apparatus, the emulsion breaking chemical injection system, water pump, desalter vessel, first impurity analyzer, and second impurity analyzer to maintain a salt concentration in the dry crude stream of less than 5 lb/1000 barrels.

In some embodiments of the apparatus, the multivariable controller can be used to control one or more operating parameters of the mixing apparatus, the emulsion breaking chemical injection system, water pump, desalter vessel, first impurity analyzer, and second impurity analyzer so as to maintain a salt concentration in the dry crude stream of less than 10 lb/1000 barrels and to maintain the BSW value of the treated dry crude stream at a maximum of 0.2% volume of the dry crude stream.

In some embodiments of the apparatus, the multivariable controller can be used to control one or more operating parameters of the mixing apparatus, the emulsion breaking chemical injection system, water pump, desalter vessel, first impurity analyzer, and second impurity analyzer so as to maintain a salt concentration in the dry crude stream of less than 5 lb/1000 barrels and to maintain the BSW value of the dry crude stream at a maximum of 0.1% volume of the dry crude stream.

In some embodiments, the predetermined correlation of BSW and TDS is based on the equation below:

$$PTB=350.5*\rho_{desalter\ outlet\ water}(1500BSW/100-BSW)*(TDS_{desalter\ outlet\ water}/10^6)/(\text{combined mixing efficiency of desalter 180 and mixing valve 170})$$

It will be understood by a person of skill in the art that the optimization of the described invention will be dependent on a number of factors, including the mixing efficiency of the water and crude. Various methods are known to improve mixing efficiency including commercially available mixing valves which have improved mixing efficiencies.

Embodiments of the present invention may suitably comprise, consist or consist essentially of the elements disclosed and may be practiced in the absence of an element not disclosed. For example, it can be recognized by those skilled in the art that certain steps can be combined into a single step.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Ranges may be expressed herein as from about one particular value, and/or to about another particular value. When such a range is expressed, it is to be understood that another embodiment is from the one particular value and/or to the other particular value, along with all combinations within the range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A process for monitoring salinity of a dry crude stream in a crude oil desalting process, the process comprising the steps of:

feeding, to a wet crude stream or a recycled water stream, at least one emulsion breaking chemical using an emulsion breaking chemical injection system having a predetermined range of operating conditions and feeding, to the wet crude stream, the recycled water stream using at least one recycled water pump having a predetermined range of operating conditions to produce an enhanced wet crude stream including water from the recycled water stream and the at least one emulsion breaking chemical, wherein the wet crude stream is fed to the crude oil desalting process by a wet crude stream pump;

feeding the enhanced wet crude stream to a first mixing apparatus having a predetermined range of operating conditions to produce a mixed wet crude stream;

feeding the mixed wet crude stream to a dehydrator vessel having a predetermined range of operating conditions to produce a reduced water content crude stream and a waste water stream;

feeding the waste water stream using at least one waste water stream pump having a predetermined range of operating conditions to a waste water facility;

feeding a wash water stream using at least one wash water pump having a predetermined range of operating conditions to the reduced water content crude stream to produce a hydrated crude stream;

feeding the hydrated crude stream to a second mixing apparatus having a predetermined range of operating conditions to produce a mixed hydrated crude stream;

feeding the mixed hydrated crude stream to a desalter vessel having a predetermined range of operating conditions to produce a dry crude stream and the recycled water stream;

feeding the dry crude stream to a first continuous online analyzing unit for determining basic sediment and water (BSW) real time data of the dry crude stream, wherein the first continuous online analyzing unit is in communication with an online analyzer and provides the BSW real time data to the online analyzer;

feeding the recycled water stream to a second continuous online analyzing unit for determining total dissolved solids (TDS) real time data of the recycled water stream from the desalter vessel, wherein the second continuous online analyzing unit is in communication with the online analyzer and provides the TDS real time data to the online analyzer;

determining, by the online analyzer, salt concentration real time data of the dry crude stream based on a predetermined correlation of BSW real time data and TDS real time data, wherein the online analyzer is in communication with a multivariable controller and provides the salt concentration real time data to the multivariable controller;

assessing, by the multivariable controller, operating parameters of any of the wet crude stream pump, recycled water pump, emulsion breaking chemical injection system, first mixing apparatus, dehydrator vessel, waste water stream pump, wash water pump, second mixing apparatus, and desalter vessel; and adjusting, by the multivariable controller, one or more of the operating parameters to maintain the salt concentration real time data within a predetermined range to minimize power usage of the crude oil desalting process, wherein the operating parameters are adjusted when the salt concentration data is outside the predetermined range and the operating parameters are adjusted within the predetermined range of operating conditions for the respective operating parameters.

2. The process of claim 1 wherein the predetermined range of the salt concentration in the dry crude stream is less than 10 lb/1000 barrels.

3. The process of claim 1 wherein at least one emulsion breaking chemical is fed to the wash water stream using a second emulsion breaking chemical injection system.

4. The process of claim 1 wherein the at least one wash water pump is operated within the predetermined range of operating conditions at a lowest level of flow required to maintain the salt concentration in the dry crude stream at less than 10 lb/1000 barrels.

5. The process of claim 1 wherein the at least one emulsion breaking chemical is injected using the emulsion breaking chemical injection system at a lowest injection rate required to maintain the salt concentration in the dry crude stream at less than 10 lb/1000 barrels.

6. The process of claim 5 wherein the injection rate is such that it results in a concentration of emulsion breaking chemical of 3-10 ppm of the mixed wet crude.

7. The process of claim 1 wherein the first mixing apparatus is operated within the predetermined range of operating conditions at a lowest mixing efficiency and the least amount of time required to maintain the salt concentration in the dry crude stream at less than 10 lb/1000 barrels.

8. The process of claim 1 wherein the dehydrator vessel is operated within the predetermined range of operating conditions at a lowest level of energy consumption required to maintain the salt concentration in the dry crude stream at less than 10 lb/1000 barrels.

9. The process of claim 1 wherein the at least one waste water stream pump is operated within the predetermined range of operating conditions at a lowest level of flow required to maintain the salt concentration in the dry crude stream at less than 10 lb/1000 barrels.

10. The process of claim 1 wherein the at least one recycled water pump is operated within the predetermined range of operating conditions at a lowest level of flow required to maintain the salt concentration in the dry crude stream at less than 10 lb/1000 barrels.

11. The process of claim 1 wherein the wet crude stream pump is operated within the predetermined range of operating conditions at a lowest level of flow required to maintain the salt concentration in the dry crude stream at less than 10 lb/1000 barrels.

12. The process of claim 1 wherein the second mixing apparatus is operated within the predetermined range of operating conditions at a lowest mixing efficiency and the least amount of time required to maintain the salt concentration in the dry crude stream at less than 10 lb/1000 barrels.

13. The process of claim 1 wherein the desalter vessel is operated within the predetermined range of operating conditions at a lowest level of energy consumption required to maintain the salt concentration in the dry crude stream at less than 10 lb/1000 barrels.

14. The process of claim 1 wherein the desalter vessel is operated within the predetermined range of operating conditions at a temperature of between 50-150° C.

15. The process of claim 1 wherein the multivariable controller adjusts the operating parameters within the predetermined range of operating conditions of the wet crude stream pump, recycled water pump, emulsion breaking chemical injection system, first mixing apparatus, dehydrator vessel, waste water stream pump, wash water pump, second mixing apparatus, and desalter vessel, such that the energy consumption of the process is at a minimum level required to maintain a salt concentration in the dry crude stream of less than 10 lb/1000 barrels.

16. The process of claim 1 wherein the BSW in the dry crude stream is less than 0.2% by volume of said dry crude steam.

* * * * *